US011286026B2

(12) United States Patent
Myhre et al.

(10) Patent No.: US 11,286,026 B2
(45) Date of Patent: Mar. 29, 2022

(54) SUBSEA INSTALLATION METHOD AND ASSEMBLY

(71) Applicant: EQUINOR ENERGY AS, Stavanger (NO)

(72) Inventors: Erling Myhre, Stavanger (NO); Bernt Karsten Lyngvær, Stavanger (NO); Sturle Næss, Stavanger (NO); Kjell Larsen, Stavanger (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 17/171,251

(22) Filed: Feb. 9, 2021

(65) Prior Publication Data

US 2021/0163108 A1 Jun. 3, 2021

Related U.S. Application Data

(63) Continuation of application No. 16/632,152, filed as application No. PCT/NO2018/050185 on Jul. 11, 2018, now Pat. No. 10,960,962.

(30) Foreign Application Priority Data

Jul. 18, 2017 (GB) ..... 1711518

(51) Int. Cl.
*E02B 17/02* (2006.01)
*B63G 8/42* (2006.01)
(Continued)

(52) U.S. Cl.
CPC ..... *B63G 8/42* (2013.01); *B63C 11/52* (2013.01); *B63G 8/22* (2013.01); *E02D 29/06* (2013.01);
(Continued)

(58) Field of Classification Search
CPC ..... E02B 17/02; B63B 27/36; B63B 27/16; B63G 8/14; B63G 2008/425; B63G 8/42; B63G 8/22; B63G 2008/007; E21B 41/08
(Continued)

(56) References Cited

U.S. PATENT DOCUMENTS 3,550,549 A * 12/1970 Horton ..... B63B 21/502 114/230.24
4,271,550 A 6/1981 Joubert et al.
(Continued)

FOREIGN PATENT DOCUMENTS

GB 2 454 660 A 5/2009
NO 339924 B1 2/2017

OTHER PUBLICATIONS

International Search Report, issued in PCT/NO2018/050185, dated Sep. 21, 2018.
(Continued)

*Primary Examiner* — Sean D Andrish
(74) *Attorney, Agent, or Firm* — Birch, Stewart, Kolasch & Birch, LLP

(57) ABSTRACT

An assembly for installing an object under water at a desired location, including a vessel arranged to carry the object; a submersible frame; and a connection between the object and the submersible frame. In use the vessel is spatially separated from the submersible frame along the direction of the water surface. The object, the connection and the submersible frame are arranged such that, when releasing the object from the vessel, the object becomes submerged and carries out a pendulum motion until the object is suspended from the submersible frame.

11 Claims, 5 Drawing Sheets

(51) Int. Cl.

| | |
|---|---|
| ***B63C 11/52*** | (2006.01) |
| ***B63G 8/22*** | (2006.01) |
| ***E02D 29/09*** | (2006.01) |
| ***E21B 33/035*** | (2006.01) |
| *B63G 8/00* | (2006.01) |

(52) U.S. Cl.
CPC ..... *E21B 33/035* (2013.01); *B63G 2008/007* (2013.01); *B63G 2008/425* (2013.01)

(58) Field of Classification Search
USPC ..... 405/203, 205, 209
See application file for complete search history.

(56) References Cited

U.S. PATENT DOCUMENTS

| | | | | |
|---|---|---|---|---|
| 4,797,035 | A | 1/1989 | Hunter | |
| 5,069,580 | A * | 12/1991 | Herwig ..... | B63C 11/34 405/191 |
| 6,042,303 | A | 3/2000 | Head | |
| 2003/0221602 | A1 | 12/2003 | Guinn et al. | |

OTHER PUBLICATIONS

United Kingdom Search Report, issued in Priority Application No. 1711518.9, dated Nov. 24, 2017.
Written Opinion of the International Searching Authority, issued in PCT/NO2018/050185, dated Sep. 21, 2018.

* cited by examiner

SUBSEA INSTALLATION METHOD AND ASSEMBLY

CROSS-REFERENCE TO RELATED APPLICATIONS

This application is a Continuation of copending U.S. application Ser. No. 16/632,152, filed on Jan. 17, 2020, which is the National Phase of PCT International Application No. PCT/NO2018/050185, filed on Jul. 11, 2018, which claims priority under 35 U.S.C. § 119(a) to Application No. 1711518.9, filed in the United Kingdom on Jul. 18, 2017, all of which are hereby expressly incorporated by reference into the present application.

BACKGROUND OF THE INVENTION

1. Field of the Invention

The invention relates to subsea installation of an object, and in particular to subsea installation of an object related to production of hydrocarbons.

2. Description of Background Art

Subsea installation of large objects may involve large vessels with cranes provided for the purpose of hoisting such large objects from the deck into the water and lowering the objects to the seabed. Examples of objects are templates and manifolds, and an example of the range of weights of such objects is 200 metric tonnes and upwards. Vessels specifically arranged for this purpose are costly and controlling the motion of a large or heavy object in air requires a larger load capacity when compared to controlling the object in water.

SUMMARY OF THE INVENTION

According to a first aspect of the invention, there is provided a method of installing an object under water at a desired location, the method comprising providing the object on a vessel, connecting the object to a submersible frame located below the water surface, wherein the vessel is spatially separated from the submersible frame along the direction of the water surface, releasing the object from the vessel such that the object becomes submerged and carries out a pendulum motion until the object is suspended from the submersible frame, moving the object to the desired location.

The submersible frame may either be connected to said vessel or may be connected to a further vessel. The connection may be by way of a tow line, a power line, or a communication line. The buoyancy of the submersible frame may be adjusted to compensate for the weight of the object suspended below the frame. The vessel or the further vessel may be used for towing the submersible frame for positioning the object. The further vessel may be used for towing the submersible frame. The object may be moved by a winch provided on the submersible frame. The method may further comprise adjusting the position of the submersible frame with a propulsion system provided on the submersible frame. Examples of the desired position of the object are the seabed, a seabed processing system, or a wellhead system. The method may further comprise controlling the drag of the connection between the object and the submersible frame by attaching one or more drag objects to the connection. The drag objects may have positive buoyancy or increase the spatial extent of the connection when compared to the connection without the drag objects.

According to a second aspect of the invention, there is provided an assembly for installing an object under water at a desired location, the assembly comprising: a vessel arranged to carry the object, a submersible frame, a connection between the object and the submersible frame, wherein in use the vessel is spatially separated from the submersible frame along the direction of the water surface, wherein the object, the connection and the submersible frame are arranged such that, when releasing the object from the vessel, the object becomes submerged and carries out a pendulum motion until the object is suspended from the submersible frame, and wherein the frame comprises a winch mechanism for moving the object to the desired location.

The assembly may further comprise a further vessel arranged to tow the submersible frame, and the submersible frame may be connected to the further vessel by a tow line, a power line, or a communication line. The submersible frame may comprise a variable buoyancy system. The assembly may further comprise a buoy connected to the submersible frame for indicating the location of the submersible frame. The assembly may further comprise a remotely operated vehicle for interacting with the object after installation of the object on the seabed. The assembly may further comprise one or more drag objects attached to the connection between the object and the submersible frame, and the drag objects may have positive buoyancy or may increase the spatial extent of the connection by the shape of the drag objects.

BRIEF DESCRIPTION OF THE DRAWINGS

Some embodiments of the invention will now be described by way of example only and with reference to the accompanying drawings, in which.

DETAILED DESCRIPTION OF THE INVENTION

Figure 1:
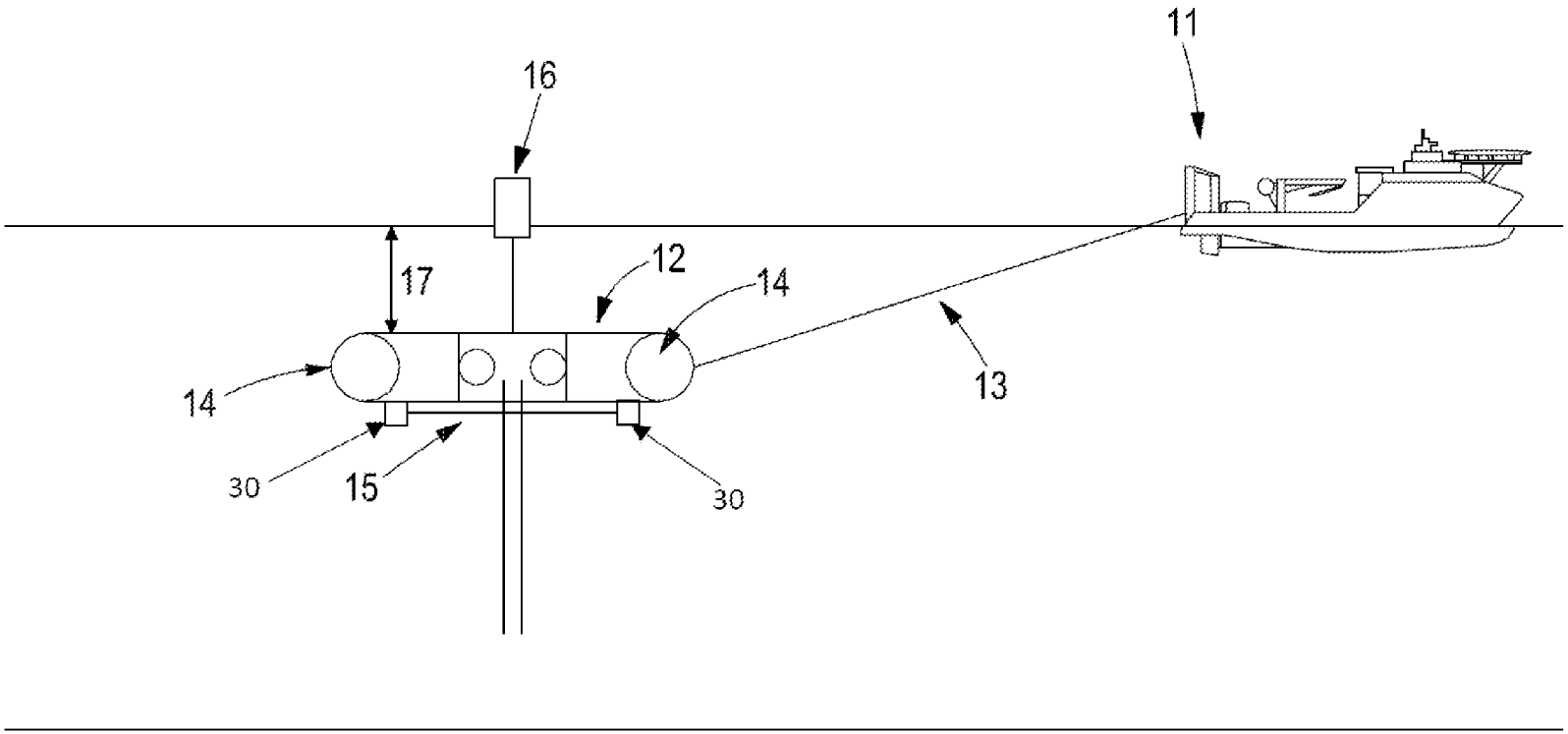
FIG. 1 illustrates a first step of a method.

The inventors have realised that handling a large or heavy object under water has advantages over handling the object above the water level in air. The buoyancy forces on the object under water will reduce the load when compared to the full load on a crane in air. Further, the water resistance will dampen motion. The method disclosed herein uses a vessel to transport the object from the shore to the area in which the object is to be installed. The object is then connected to a submersible frame which is located under the water surface. The object is released from the vessel by sliding or dropping the object into the water. The submersible frame and vessel are positioned with some horizontal distance in between. The object will start dropping into the water. The connection between the frame and the object can initially be loose, such as a connection provided by a cable with some slack. When the object starts dropping, the connection will become tighter due to the separation between the vessel and the frame. The object will subsequently carry out a pendulum motion until at rest underneath the frame. The object can finally be moved to a desired location, for example by a winch mechanism at the frame lowering the object onto the seabed or onto a wellhead system.

The pendulum motion takes place because the effective inertia of the frame is much larger than the inertia of the object, so the frame will move much less than the object. The effective inertia of the frame can be made large by connecting the frame to a further vessel which is located on a side of the frame opposite to the side of the first vessel. The effective inertia of the frame can also be made large by giving the frame a shape which increases movement of surrounding water as a result of the frame moving. A smooth shape will cause less movement of water when compared to a shape with many surfaces and cavities. The movement of the water gives rise to added mass, or virtual mass and the inertia of the frame will be increased due to the added mass.

The motion is referred to as pendulum motion herein, which is not restricted to oscillatory motion in which the object moves forth and back around an equilibrium position. Pendulum motion includes an overdamped oscillatory motion in which the object slowly approaches the equilibrium position without moving past the equilibrium position. Some numerical simulations of the pendulum motion of an object in water with realistic parameters carried out by the inventors show that the time period between release of the object and proximity to the equilibrium position can be around 30 minutes.

The method disclosed herein has several advantages over methods involving a crane. The loads and motions of the object in air are avoided because the object is not hoisted with a crane from deck and down to the sea surface. Further, the loads are reduced while entering through the splash zone because there are no forces interacting at a crane hook. There is also no risk of snapping of cables due to sudden changes in load on the cable due to wave motion.

The method will also lead to reduced dynamic loads while lowering the object through the water because the submersed frame is stable and unaffected by waves unlike a vessel which is subject to wave motion and weather. For a crane, passive and active heave compensation is required but a submersed frame will not need compensation for wave motion. The pendulum motion of the object in water will also be damped due to the resistance of the water.

The method may be implemented in different ways. It is possible to use two vessels: a first one to transport and drop the object, and a second one on the opposite side of the frame to keep the frame in place during the pendulum motion. Alternatively, a single vessel can be used when the frame is kept in place due to the effective mass of the frame being much larger than the effective mass of the object. In yet a different example, a single vessel is used and the frame has active propulsion which is used for positioning the frame, but the active propulsion will add costs to construction and use of the frame. The active propulsion can be used to transport the frame from the shore to the position where the operation of lowering the object will take place. The active propulsion system can further be used to maintain a safe distance between the frame and the vessel from which the object is released. The active propulsion system can further be used to enable a precise positioning of the object on the seabed. The frame and active propulsion system together form an unmanned sub which can move autonomously, or which is controlled remotely.

An example of a frame is a sub with a longitudinal cylindrical shape similar to a classical submarine. The smooth shape will result in more motion of the sub when compared to an irregular shape during the pendulum motion, but that does not need to be a problem. When moving to the site at which the lowering operation of the object will take place, the longitudinal axis of the sub has a horizontal orientation to enable efficient movement of the sub. During operation, however, the longitudinal axis of the sub has a vertical orientation whereby a winch mechanism for supporting the object is provided at the lowest point of the sub. The vertical orientation will provide a more stable arrangement when compared to a horizontal orientation whereby the winch mechanism is provided at a central location of the sub.

When the object becomes suspended underneath the frame, variable buoyancy within the frame is used to keep the frame in the correct vertical location. An example of a variable buoyancy system is a variable volume buoyancy bag which is inflated to increase buoyancy and which is deflated to decrease buoyancy. Another example is a pressure tight tank which can selectively be filled with water or gas to vary the buoyancy.

A trim system may be provided which is arranged to keep the frame in a stable horizontal position. An example of a trim system is a plurality of tanks 30 (see FIG. 1) provided around the perimeter of the frame, whereby the tanks are filled with a fluid and are interconnected such that the weight of the fluid can be actively moved around the tanks to keep the frame horizontal.

The expressions 'sea surface' and 'sea bed' are used herein, but the method is not restricted to use in a sea and the method is also suitable for use in lakes, oceans, or other volumes of water in which heavy objects are installed under the water surface.

An embodiment is illustrated in FIG. 1. A vessel 11 tows a submerged frame 12 to a desired location by way of a towline 13. The towline 13 can additionally be used for communication with the frame. The frame has one or more variable buoyancy elements 14, such as variable buoyancy bags. The frame has a winch system 15 for raising or lowering a load. Optionally, a buoy 16 can be provided which is connected to the submerged frame with a cable and which can be used for easily determining the position of the frame and for communication between the frame and the vessel.

The frame is located at a distance 17 of around 100 m below the water surface. This distance is chosen such that the frame is not subject to wave motion and weather conditions at the water surface. A distance of 50 m would also achieve the same effect, depending on how large the waves are, and at distances deeper than 100 m the same effect will also be achieved.

Figure 2:
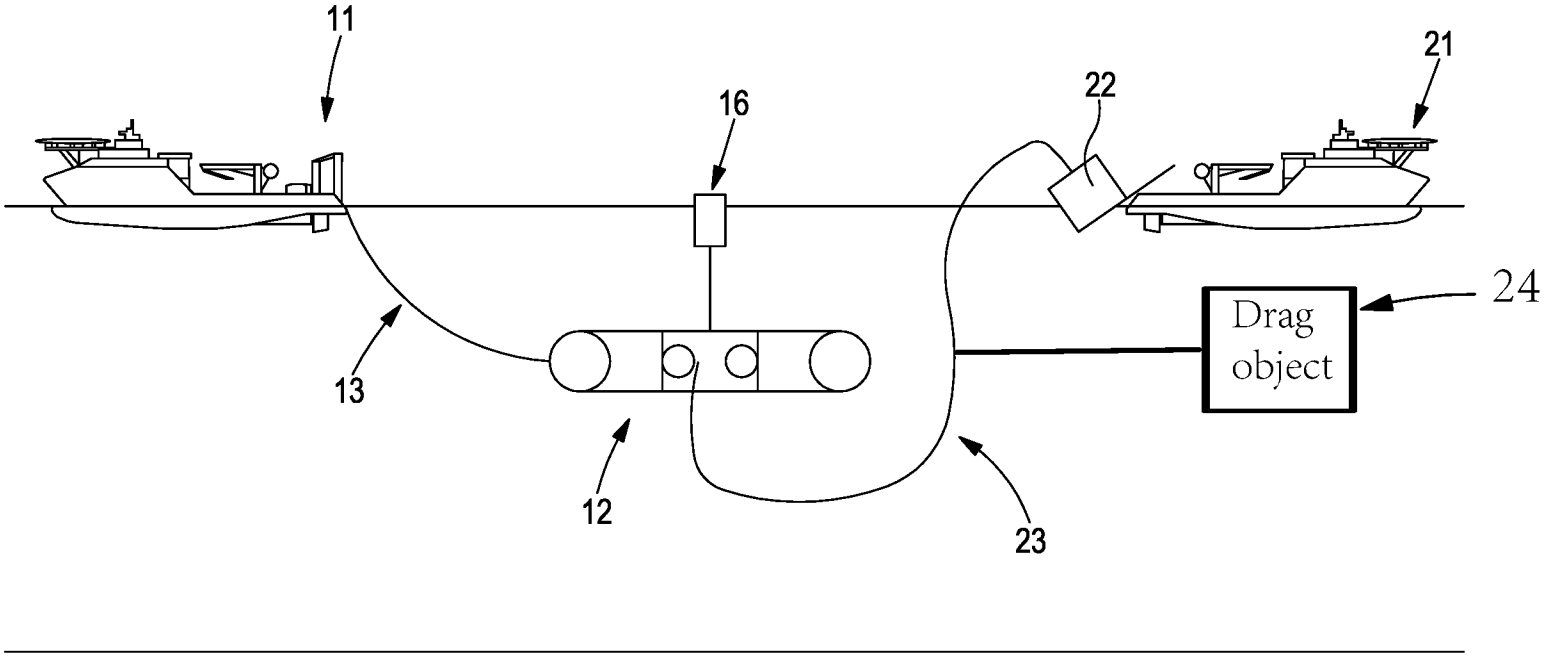
FIG. 2 illustrates a second step of the method.

FIG. 2 illustrates a next step of the method of using the frame. Vessel 11, submerged frame 12, buoy 16 and towline 13 are the same as the elements with the same reference numbers illustrated in FIG. 1. Towline 13 has some slack in this embodiment such that during installation vessel 11 and frame 12 do not directly influence each other's hydrodynamic properties. The towline can still be used for communication and power supply during installation and during the pendulum motion. A second vessel 21 is provided which is illustrated at the moment it drops object 22 into the water. A fibre rope 23 or other rope with slack connects object 22 and frame 12. A drag object 24 is attached to the fibre rope 23 between the object 22 and the frame 12.

Figure 3:
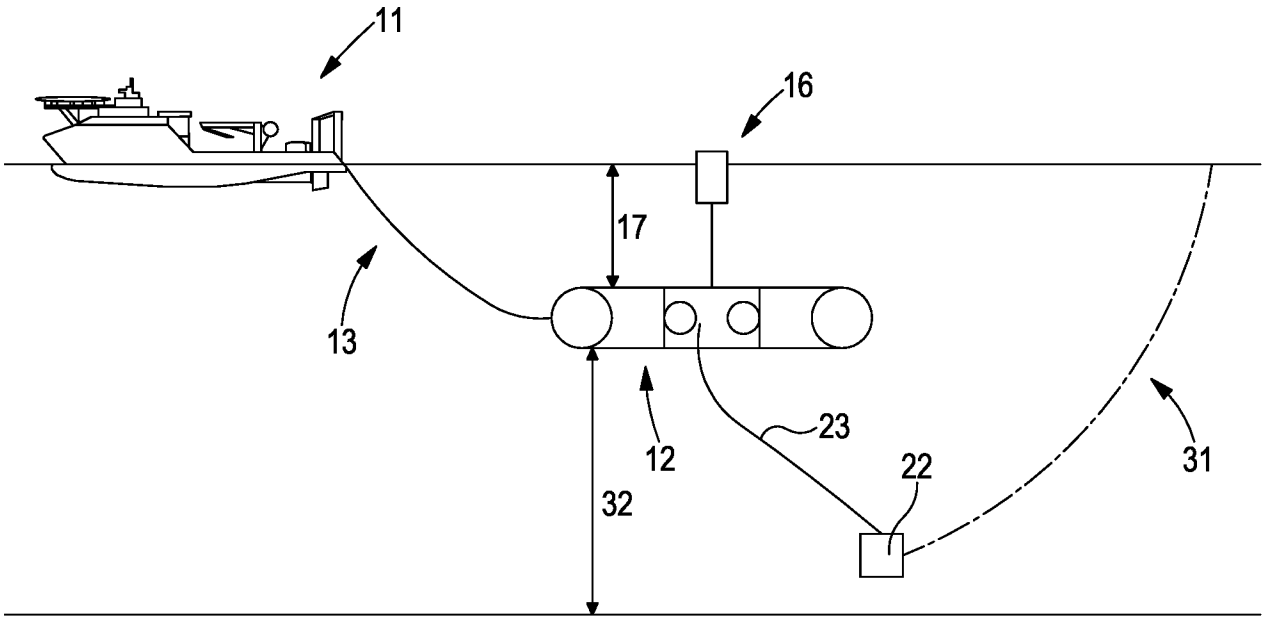
FIG. 3 illustrates a third step of the method.

FIG. 3 illustrates a next phase of the method of using the frame. The elements with the same reference numerals as in FIGS. 1 and 2 illustrate the same elements. Line 31 illustrates the trajectory carried out by object 22 during pendulum motion underneath frame 12. While the frame is located about 100 metres below the surface, the distance to the seabed 32 may be as deep as 3 km.

Figure 4:
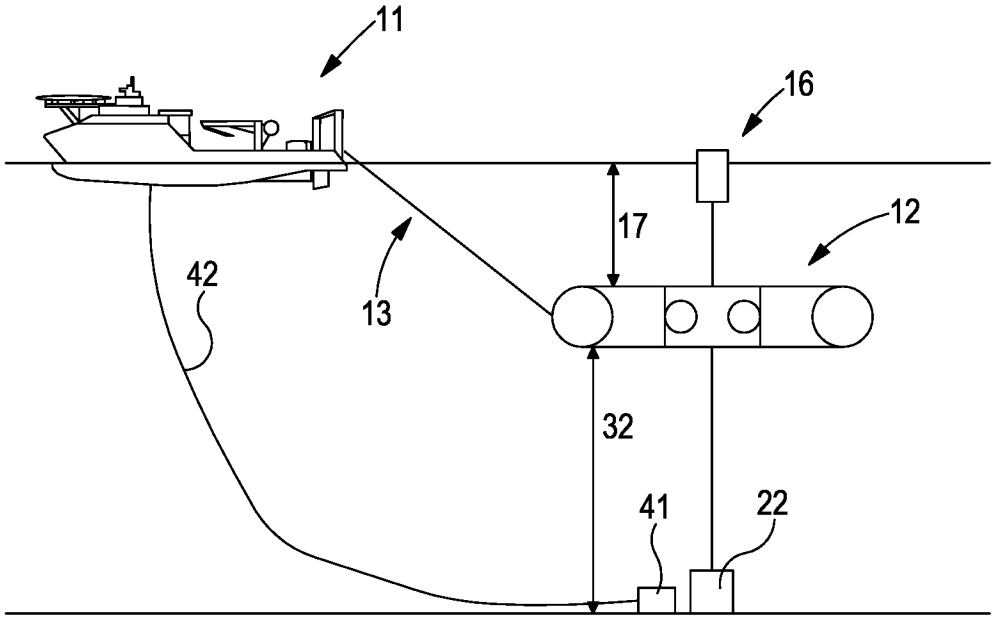
FIG. 4 illustrates a fourth step of the method.

FIG. 4 shows a final phase of the method in which the object 22 has been lowered onto the seabed by way of the winch mechanism which provided in the frame 12. Additionally, a remotely operated vehicle 41 is illustrated which is used to interact with the object 22 and which is connected to vessel 11 with a cable 42.

In the illustrations described above, a buoy 16 is provided which is connected to the submerged frame with a cable and which can be used for easily determining the position of the frame underwater and for communication between the frame and the vessel. In those illustrations, the buoy does not contribute to the buoyancy or the dynamics of the submerged frame. A contribution by the buoy to the buoyancy of the submerged frame can be avoided by using a loose connection, or by using a connection which is adaptable in length. The shape of the buoy can also be a cylindrical shape which is positioned with the longitudinal axis of the cylinder in a vertical direction.

In a further illustration, the buoy does contribute to maintaining a relatively constant depth of the buoyancy frame. The connection between the buoy and the frame can be fixed in that illustration. If the depth of the buoyancy frame increases, the submerged part of the buoy will increase, and the buoyancy of the system will increase. If the depth of the buoyancy frame decreases, the submerged part of the buoy will decrease, and the buoyancy of the system will decrease. The shape of the buoy will determine whether the change in buoyance will be linear or exponential with the change in depth. Instead of a cylindrical shape, a cone shape could be used to achieve an exponential change.

The submerged frame is less sensitive to wave motion when compared to a vessel at the water surface. The buoy will be sensitive to wave motion, and a fixed connection to the submerged frame will cause an increased sensitivity of the frame to wave motion. However, the buoyancy contribution of the buoy occurs at a stage where wave forces are of limited importance, which is the stage at which the sub is adjusting the buoyancy when taking the full vertical load of the template. This stage occurs slightly after the step illustrated in FIG. 3. After this stage has been completed, which is at the end of the pendulum motion, the buoyancy contribution from the buoy is not required anymore and the connection between the buoy and the frame can be changed to a flexible connection. If the buoy is shaped longitudinally with a small cross sectional area along the water surface, the water line area will be small and the impact of waves will be small in dependence of vertical motion.

In an example, the connection between the buoy and the frame can be adjusted in length and can be changed from an adjustable connection to a fixed connection. A cable and a winch mechanism could for example be used for adjusting the length and the winch mechanism can be locked in order to provide a fixed connection. If the submersible frame required additional buoyancy, the connection can be tightened.

The properties of rope 23 or of another cable connecting the object and frame can also be varied to control the dynamics of the pendulum motion. A thicker cable will have a larger effective inertia when compared to a thinner cable and the larger effective inertia will cause a damping of the movement of the cable. In an embodiment, one or more objects are attached to the cable to control the dynamics of the cable. The objects can have positive buoyancy or only have a particular shape to affect the drag without having additional positive buoyancy. In an example, a plurality of positive buoyancy objects are spaced along the cable, at regular intervals or irregular intervals, between the object and the frame. In another example, a plurality of objects with a parachute shape or other shape with a larger surface area than that of the cable are spaced along the cable at regular or irregular intervals to increase drag during motion of the cable through the water.

Figure 5:
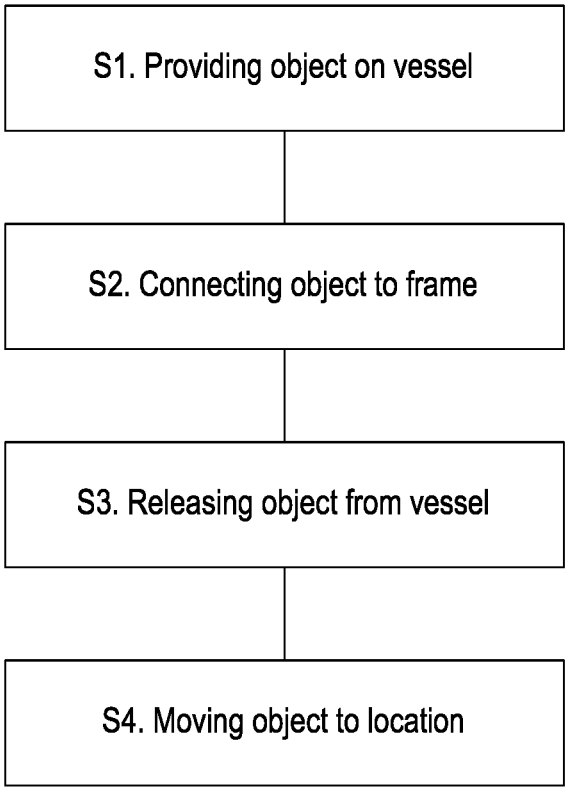
FIG. 5 is a flow diagram of the method.

FIG. 5 is a diagram of the method disclosed herein, including the steps of providing the object on a vessel (S1), connecting the object to a submersible frame located below the water surface (S2), releasing the object from the vessel (S3) such that the object becomes submerged and carries out a pendulum motion until the object is suspended from the submersible frame, and finally moving the object to the desired location (S4).

Although the invention has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims. Each feature disclosed or illustrated in the present specification may be incorporated in the invention, whether alone or in any appropriate combination with any other feature disclosed or illustrated herein.

The invention claimed is:

1. An assembly for installing an object under water at a desired location, the water comprising a water surface, the assembly comprising:

a vessel arranged to carry the object;

a submersible frame;

a connection between the object and the submersible frame, wherein in use the vessel is spatially separated from the submersible frame along a direction of the water surface; and a buoy connected to the submersible frame for indicating a location of the submersible frame, wherein the object, the connection and the submersible frame are arranged such that, when releasing the object from the vessel, the object becomes submerged and carries out a pendulum motion until the object is suspended from the submersible frame, wherein the frame comprises a winch mechanism for moving the object to the desired location, and wherein the buoy is connected to the submersible frame with an adjustable cable.

2. The assembly according to claim 1, further comprising a further vessel arranged to tow the submersible frame.

3. The assembly according to claim 2, wherein the submersible frame is connected to the further vessel by a tow line, a power line, or a communication line.

4. The assembly according to claim 1, wherein the submersible frame comprises a variable buoyancy system.

5. The assembly according to claim 1, further comprising a remotely operated vehicle for interacting with the object after installation of the object on the seabed.

6. The assembly according to claim 1, wherein the cable is adjusted such that the buoyancy of the buoy provides a buoyancy force to the submersible frame.

7. The assembly according to claim 1, further comprising one or more drag objects attached to the connection between the object and the submersible frame.

8. The assembly of claim 7, wherein the one or more drag objects have positive buoyancy or increase a spatial extent of the connection by a shape of the one or more drag objects.

9. The assembly of claim 1, wherein the effective inertia of the frame is larger than the effective inertia of the object.

10. The assembly of claim 1, wherein the frame comprises an active propulsion system.

11. The assembly of claim 1, wherein the frame comprises a trim system, wherein the trim system comprises a plurality of tanks provided around the perimeter of the frame, and wherein the tanks are filled with a fluid an and fluidly connected to each other to control an orientation of the frame.

* * * * *